US009301656B2

(12) United States Patent
Lee

(10) Patent No.: US 9,301,656 B2
(45) Date of Patent: Apr. 5, 2016

(54) MOUNTABLE FULL BACK SCRUBBING APPARATUS

(71) Applicant: Willie Frank Lee, Mount Vernon, GA (US)

(72) Inventor: Willie Frank Lee, Mount Vernon, GA (US)

( * ) Notice: Subject to any disclaimer, the term of this patent is extended or adjusted under 35 U.S.C. 154(b) by 0 days.

(21) Appl. No.: 14/250,614

(22) Filed: Apr. 11, 2014

(65) Prior Publication Data

US 2015/0289727 A1 Oct. 15, 2015

(51) Int. Cl.
*A47K 7/02* (2006.01)

(52) U.S. Cl.
CPC ..... *A47K 7/024* (2013.01)

(58) Field of Classification Search
CPC ..... A47K 7/02; A47K 7/024; A61H 7/00
USPC ..... 15/160, 104.92, 210.1, 244.3, 244.1; 4/606; 601/136
See application file for complete search history.

(56) References Cited

U.S. PATENT DOCUMENTS 3,289,215 A 12/1966 Kennedy
3,478,369 A 11/1969 Ensley
3,862,459 A 1/1975 Brunette
4,014,051 A 3/1977 Pettit
5,836,035 A 11/1998 McElfish et al.
6,370,722 B1 4/2002 Duckworth
6,996,861 B1 2/2006 Clark, Jr.
7,120,947 B1 10/2006 Magallanes
D707,889 S * 6/2014 Miller ..... D28/63
2013/0283552 A1* 10/2013 Wang ..... 15/105
2015/0059110 A1* 3/2015 Crooks ..... 15/110

* cited by examiner

*Primary Examiner* — Shay Karls
(74) *Attorney, Agent, or Firm* — The Keys Law Firm PLLC

(57) ABSTRACT

A full back scrubbing apparatus for allowing a user to scrub his entire back area simultaneously while in the shower. The a full back scrubbing apparatus comprises a front surface defined by a scrubbing body sized to be at least as long as a user's body from his waist to his neck and at least as wide as a user's shoulders and a back surface defined by a plurality of fasteners. The front surface includes a plurality of ridges disposed around the perimeter and a plurality of bristles disposed throughout its interior. The ridges and bristles provide the on surface friction is generated when a user rubs his back against the full back scrubbing apparatus. The back surface includes a suction cup fastener disposed on the exterior area of the back surface and a hook and loop fabric fastener is disposed on the interior area.

6 Claims, 1 Drawing Sheet

MOUNTABLE FULL BACK SCRUBBING APPARATUS

BACKGROUND OF THE INVENTION

1. Field of the Invention

This invention relates generally to hygiene accessories and, more particularly, to a mounted back washing apparatus for enabling a user to create friction across their entire back while showering.

2. Description of the Prior Art

It is well established that for cleaning purposes, generating friction on the surfaces to be cleaned, when followed by rinsing, is an effective way to remove soils and bacteria therefrom. In this regard, the use of scrubbing devices to generate friction while cleaning the surface of a user's skin is well known. Often times, scrubbing devices are adapted with extended handles to additionally enable a user to reach, and create friction, or areas of the body which cannot be reached by hand. Conventional back scrubbers customarily include a scrubbing brush portion disposed at the end of an elongated handle and often serve such a purpose. A problem which still exists, however, is that due to the size of the brush portion on conventional back scrubbers, it is often difficult to generate sufficient friction on all areas of the back with a conventional back scrubbers. Thus, there remains a need for a full back scrubbing apparatus which has a surface area that allows a user to generate scrubbing action across his entire back. It would be helpful if such a full back scrubbing apparatus was adapted to be mounted in a shower so that a user could simply back up into it. It would be additionally desirable for such a mountable full back scrubbing apparatus to include a plurality of types of friction generating surfaces.

The Applicant's invention described herein provides for a full back scrubbing apparatus adapted to be mounted in the shower. The primary components in Applicant's full back scrubbing apparatus are a scrubbing body and mounting surfaces. When in operation, the full back scrubbing apparatus enables a user to generate cleaning friction action across his entire back simultaneously. As a result, many of the limitations imposed by prior art structures are removed.

SUMMARY OF THE INVENTION

A full back scrubbing apparatus for allowing a user to scrub his entire back area simultaneously while in the shower. The a full back scrubbing apparatus comprises a front surface defined by a scrubbing body sized to be at least as long as a user's body from his waist to his neck and at least as wide as a user's shoulders and a back surface defined by a plurality of fasteners. The front surface includes a plurality of ridges disposed around the perimeter and a plurality of bristles disposed throughout its interior. The ridges and bristles provide the on surface friction is generated when a user rubs his back against the full back scrubbing apparatus. The back surface is adapted to be attached to a wall in a shower through presence of a suction cup fastener disposed on the exterior area of the back surface and a hook and loop fabric fastener is disposed on the interior area. Fasteners are employed to attach the full back scrubbing apparatus to the wall on both its exterior and interior areas in order to improve stability, as it is understood that a user rubbing his back against the entire surface of the full back scrubbing apparatus will create pulling and tugging throughout the full back scrubbing apparatus, including the exterior and interior areas.

It is an object of this invention to provide a full back scrubbing apparatus which has a surface area that allows a user to generate scrubbing action across his entire back.

It is another object of this invention to provide a full back scrubbing apparatus adapted to be mounted in a shower so that a user could simply back up into it.

It is yet another object of this invention to provide a mountable full back scrubbing apparatus to include a plurality of types of friction generating surfaces.

These and other objects will be apparent to one of skill in the art.

DETAILED DESCRIPTION OF THE INVENTION

Figure 1:
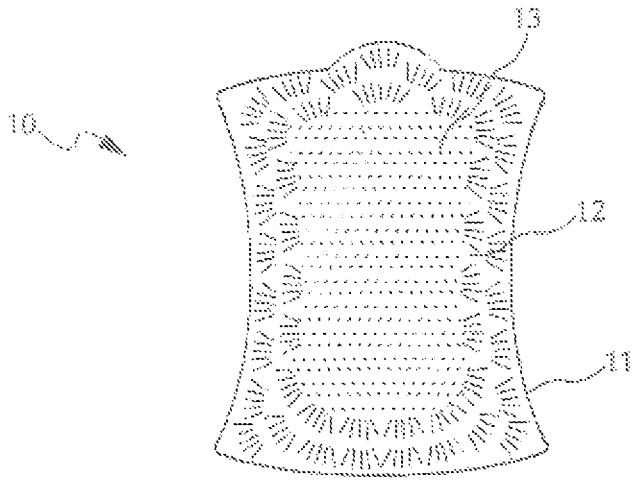
FIG. 1 is a front elevational view of a full back scrubbing apparatus built in accordance with the present invention.
Figure 2:
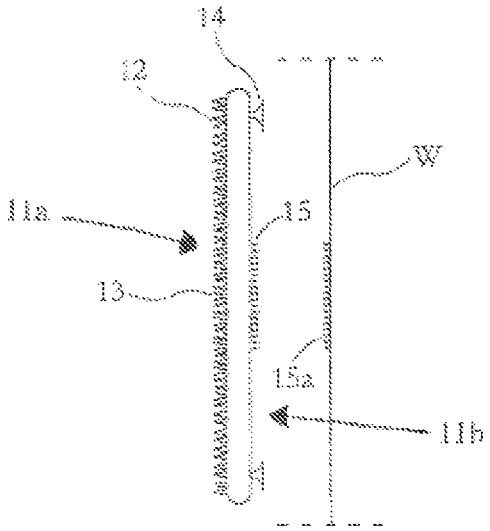
FIG. 2 is a side elevational view of a full back scrubbing apparatus built in accordance with the present invention.

Referring now to the drawings and in particular FIGS. 1 and 2, a full back scrubbing apparatus 10 is shown having a scrubbing body 11 sized to be at least as long as a user's body from his waist to his neck and at least as wide as a user's shoulders. In this regard, the scrubbing body 11 enables a user to scrub his entire back simultaneously. The scrubbing body 11 is defined by a front surface 11*a* and a back surface 11. The front surface 11*a* includes a plurality of ridges 12 disposed around the perimeter and a plurality of bristles 13 disposed throughout its interior. The presence of two types of friction generating aspects, ridges 12 and bristles 13, improves the ability of the scrubbing body 11 to generate friction as a user moves from side to side or up and down across the scrubbing body 11 as the ridges 12, due to their thickness, provide a deeper agitation than the bristles 13. In addition, the ridges 12 are able to provide a massaging action while the full back scrubbing apparatus 10 is in use.

The back surface 11*b* is adapted to be attached to a wall W in a shower. through presence of two discrete fastener systems. A suction cup fastener 14 is disposed on the exterior area of the back surface 11*b* and a hook and loop fabric fastener 15 is disposed on the interior area. A corresponding hook and loop fabric fastener 15*a* is disposed on the wall W. The back surface 11*b* includes fasteners to attach to the wall on both its exterior and interior areas in order to improve stability, as it is understood that a user rubbing his back against the entire surface of the full back scrubbing apparatus 10 will create pulling and tugging throughout the full back scrubbing apparatus 10, including the exterior and interior areas. As such, this pulling and tugging must be resisted by fasteners in both areas. While two discrete fastener systems are shown in the preferred embodiment, it is contemplated that one fastener system can be employed provided it is deployed in both the exterior and interior areas of the back surface 11*b*.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A full back scrubbing apparatus, comprising:

a planar scrubbing body sized to enable a user to scrub his entire back simultaneously, wherein the scrubbing body is defined by a front surface and a back surface;

a plurality of discrete, adjacent sections of agitators permanently attached to and extending from the front surface, wherein said sections of agitators include a discrete section of a plurality of ridges which completely surrounds a discrete section of a plurality of bristles; and at least one fastening surface integral with the back surface to enable the scrubbing body to be mounted on a wall.

2. The full back scrubbing apparatus of claim 1, wherein the at least one fastening surface creates a point of attachment with the wall around the exterior area of the back surface and the interior area of the back surface.

3. The full back scrubbing apparatus of claim 2, wherein the fastening surface is defined by a plurality of suction cups.

4. The full back scrubbing apparatus of claim 2, wherein the fastening surface is defined by a fabric hook and loop fastener.

5. The full back scrubbing apparatus of claim 2, wherein an exterior fastening surface and an interior fastening surface are disposed on said back surface.

6. The full back scrubbing apparatus of claim 5, wherein the exterior fastening surface is defined by a plurality of suction cups and the interior fastening surface is defined by a fabric hook and loop fastener.

* * * * *